US006047710A

United States Patent [19]

Irving et al.

[11] Patent Number: 6,047,710

[45] Date of Patent: Apr. 11, 2000

[54] HERMETIC COMPACT CASE

[75] Inventors: Christopher Darrell Irving, Warren; Garfield Litton, Glenrock; Barbara Bone Poder, Brick; Douglas Brian Silady, Edison; Albert Joseph Stiso, Brick; James J. Thalheimer, Toms River; Robert John Wilczynski, Perth Amboy, all of N.J.

[73] Assignee: Revlon Consumer Products Corporation, New York, N.Y.

[21] Appl. No.: 09/059,029

[22] Filed: Apr. 13, 1998

[51] Int. Cl.[7] ..... A45D 33/00

[52] U.S. Cl. ..... 132/293; 132/294; 132/315; 206/581

[58] Field of Search ..... 132/293, 294, 132/295, 296, 297, 298, 299, 300, 301, 315, 304, 305; 206/581, 823, 235; 220/324, 326, 344

[56] References Cited

U.S. PATENT DOCUMENTS

| | | | |
|---|---|---|---|
| 1,612,409 | 12/1926 | Anderson | 132/295 |
| 1,642,780 | 9/1927 | Kole et al. | 132/295 |
| 1,959,629 | 5/1934 | Kasdan | 132/83 |
| 2,083,016 | 6/1937 | Hammerling | 132/82 |
| 2,424,817 | 7/1947 | Grassi | 132/83 |
| 2,465,491 | 3/1949 | Storch | 132/82 |
| 4,454,889 | 6/1984 | Contreras | 132/82 |
| 4,586,519 | 5/1986 | Seidler | 132/83 |
| 4,681,127 | 7/1987 | Gueret | 132/82 R |
| 4,781,288 | 11/1988 | Wing | 206/37 |
| 5,107,871 | 4/1992 | Butcher | 132/304 |
| 5,431,177 | 7/1995 | Kecman | 132/303 |
| 5,542,561 | 8/1996 | Slink et al. | 220/291 |
| 5,875,795 | 3/1999 | Bouix | 132/293 |
| 5,896,866 | 4/1999 | Quennessen | 132/293 |
| 5,908,037 | 6/1999 | Pierson | 132/293 |

*Primary Examiner*—Gene Mancene
*Assistant Examiner*—Pedro Philogene
*Attorney, Agent, or Firm*—Julie Blackburn

[57] ABSTRACT

A compact for holding a cosmetic composition under substantially air tight conditions when in the closed position, comprising a base having a compartment with side walls for storing the cosmetic composition, and threaded engaging means on the outer peripheral surface of the side walls, a cover having threaded engaging means on the inner surface thereof, capable of mating with the threaded engaging means on the outer peripheral surface of the compartment side walls to close the compact, a sealing means between the inner surface of the cover means and the top peripheral surface of the compartment side walls which provides substantially air-tight conditions when the compact is in the closed position, a cosmetic product dispensing means fitted on top of the cosmetic composition stored in the compartment of the base means, having a plurality of aperatures which permit the cosmetic composition to be released through the aperatures upon application of pressure to the dispensing means.

21 Claims, 6 Drawing Sheets

HERMETIC COMPACT CASE

TECHNICAL FIELD

The invention relates in general to containers which provide substantially air tight or hermetic seals, and in particular cosmetic containers which are hermetically sealed to prevent evaporation of the volatile components found in cosmetic compositions.

BACKGROUND OF THE INVENTION

Color cosmetics containing high percentages of volatile ingredients are very desireable from the consumer standpoint. Generally such cosmetics are applied to skin in the liquid state. The volatile ingredients rapidly evaporate after application, leaving a light, subtle film on the skin. Often this film exhibits improved adherence to skin because the liquid ingredients have evaporated and are thus not present to interfere with adhesion of the film to the skin. Examples of volatile ingredients that can be used in the formulation of such color cosmetics include volatile silicones, paraffinic hydrocarbons, and similar materials. Until recent years, volatile ingredients were not widely used in color cosmetics because adequate packaging was not available. In particular, because volatile solvents rapidly evaporate upon contact with air, air tight packaging is essential to prevent the ingredients from evaporating out of the composition while it is stored in the container. Accordingly, there is a need for cosmetic containers capable of providing an air tight seal which enable marketing of cosmetic compositions containing high percentages of volatile ingredients.

It is an object of the invention to provide a compact for storing cosmetic which provides a substantially air tight seal when in the closed position.

It is also an object of the invention to provide a compact which provides for controlled dispensing of the cosmetic composition by means of a product dispensing means fitted on top of the cosmetic.

It is also an object of the invention to provide a hermetically sealed compact which contains a window to permit viewing of the cosmetic while the container is in the closed position.

It is also an object of the invention to provide a hermetically sealed compact capable of storing a colored cosmetic composition having a high percentage of volatile ingredients.

SUMMARY OF THE INVENTION

The invention is directed to a compact for storing a cosmetic composition under substantially air tight conditions when in the closed position, comprising:

(a) a base means having a compartment with side walls for storing the cosmetic composition, and threaded engaging means on the outer peripheral surface of the side walls, (b) a cover means having threaded engaging means on the inner surface thereof, capable of mating with the threaded engaging means on the outer peripheral surface of the compartment side walls to close the compact, (c) a sealing means between the inner surface of the cover means and the top peripheral surface of the compartment side walls which provides substantially air-tight conditions when the compact is in the closed position, (d) a cosmetic product dispensing means fitted on top of the cosmetic composition stored in the compartment of the base means, having a plurality of aperatures which permit the cosmetic composition to be released through the aperatures upon application of pressure to the dispensing means.

DETAILED DESCRIPTION OF THE DRAWINGS

Figure 1:
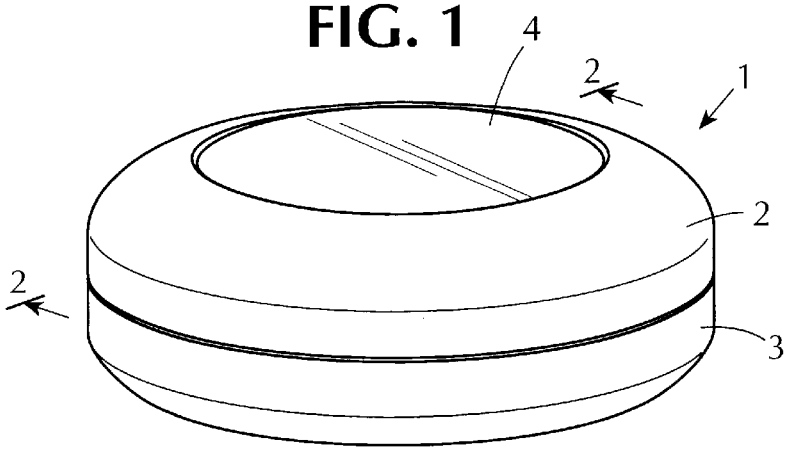
FIG. 1: is a perspective view of the compact in the closed position.
Figure 4:
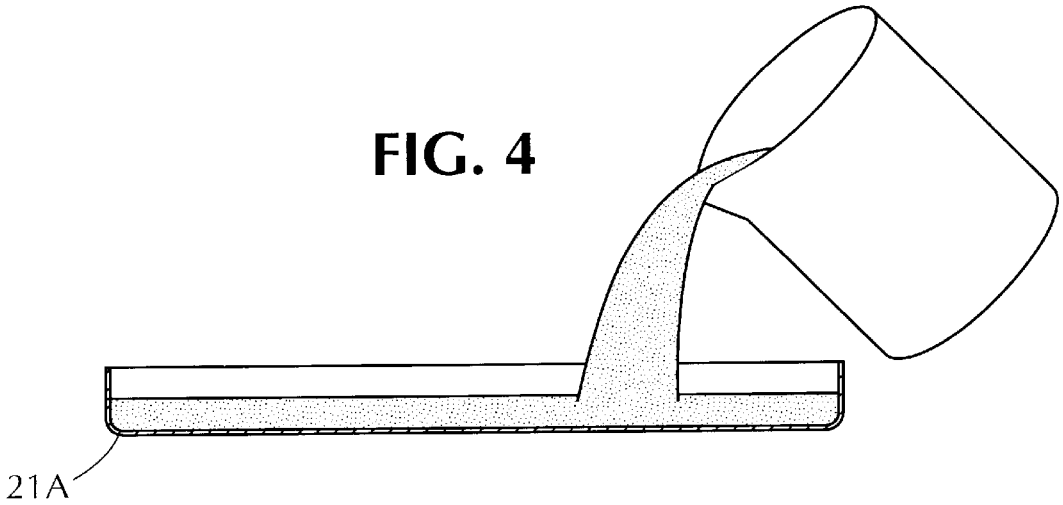
FIG. 4: illustrates how the cosmetic contained in the compact can be poured into a pan, which is then inserted into the base means.
Figure 5:
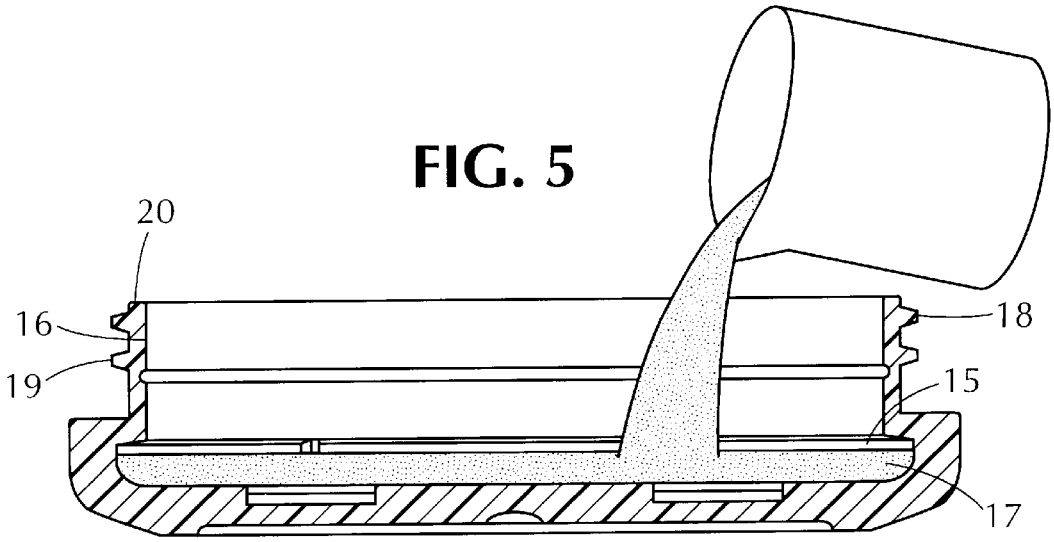
FIG. 5: illustrates how the cosmetic contained in the compact can be poured directly into the base means.

FIG. 1 illustrates a compact 1 in accordance with the invention in the closed position. Preferably the compact is made of a synthetic polymeric material, such as plastics formed by polymerization of monomer units such as ethylene, propylene, styrene, and mixtures thereof. The compact comprises a cover means 2 and a base means 3. The base means 3 comprises a compartment 15 with sidewalls 16 for storing a cosmetic composition 17. The sidewalls 16 have an outer peripheral surface 18 having threaded engaging means 19 which are preferably screw threads, and enable the base means 3 to be secured to the cover means 2. The sidewalls 16 of the base means 3 have a top peripheral surface 20 which is preferably flat. When the cover means 2 and base means 3 are secured when the compact is in the closed position, the top peripheral surface 20 of the sidewalls 16 will compress against the sealing means 14 of the cover means 2 (see FIGS. 2 and 8) to form an airtight seal. The cosmetic 17 can be poured directly into the compartment 15 of the base means 3, as illustrated in FIG. 5. This "direct filling" is cost effective because it eliminates an extra piece, i.e. the pan 21A, and enables assembly of the compact 1 in a shorter period of time. In the alternative, the cosmetic 17 can be poured into a pan 21A as illustrated in FIG. 4. The pan 21A is generally made of a metal material such as aluminum or plastic. The pan 21A may then be secured into the compartment 15 of the base means by using an adhesive, for example. The preferred embodiment of the invention is where the base means 3 is direct filled, i.e. the cosmetic material is poured directly into the base means 3 and not into a pan.

Figure 6:
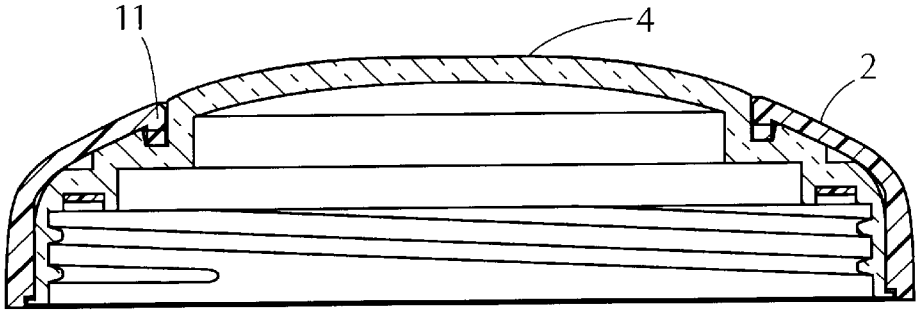
FIG. 6: illustrates a cover means used in one embodiment of the invention, which is in two pieces.
Figure 7:
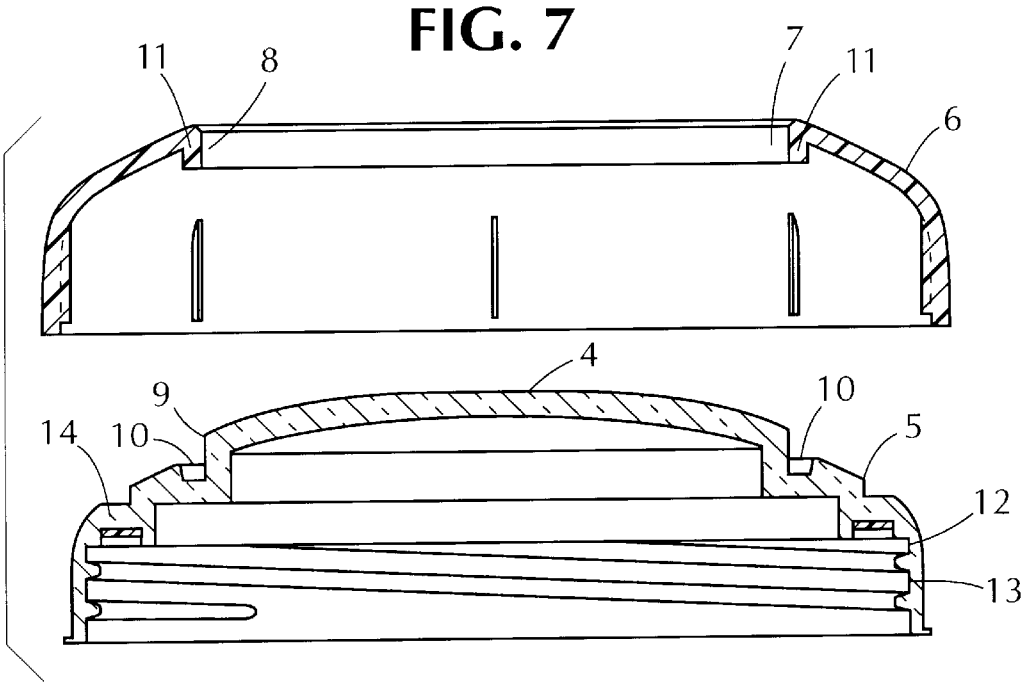
FIG. 7: is an exploded view of the cover means of FIG. 6.
Figure 8:
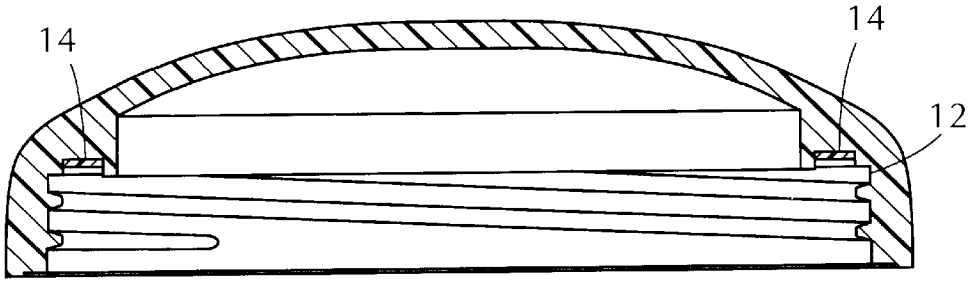
FIG. 8: shows a cover means used in another embodiment of the invention, which is in one piece.

The cover means 2 may contain a viewing window 4 which enables the consumer who purchases the cosmetic to see the color and texture through the window 4. In one embodiment of the invention, the cover means 2 contains such a viewing window 4. A cover means 2 having such a viewing window 4 in accordance with one embodiment of the invention can be seen in FIGS. 6 and 7. FIG. 6 illustrates the cover means 2 with a viewing window 4. FIG. 7 illustrates that such a cover means 2 is formed of two pieces. A first base piece 5 contains the viewing window 4. The viewing window 4 has sidewalls 9. The base piece 5 is preferably made entirely of a clear thermoplastic material, however the base piece may be molded from more than one type of thermoplastic material, i.e. the viewing window 4 may be made of clear thermoplastic material, and the rest of the base piece 5 of a thermoplastic material that is colored. Obviously it is advantageous to make the entire base piece 5 of clear thermoplastic material, because it enables molding in one piece, which reduces cost and inconvenience in the manufacturing process. The second part of the cover means 2 is a slip on jacket 6, which is adapted to fit the base piece 5 securely, having an opening 7 with sidewalls 8 having a circumference which is slightly larger than the circumference of the sidewalls 9 of the viewing window 4 of the base piece 5. This enables the jacket 6 to fit securely over the base piece 5 so that the viewing window 4 of the base piece 5 protrudes through the opening 7 and fits securely against the sidewall 8 of the jacket 6. Preferably, the base piece 5 contains two depressions 10 on either side of the sidewalls 9 of the viewing window 4, and the jacket 6 contains two protrusions 11. The protrusions 11 are preferably square in shape and designed to fit snugly into the depressions 10, which are of a similar size and shape as the protrusions, in order to facilitate securing of the base piece 5 to the jacket 6. FIG. 8 illustrates a cover means 2 used in another embodiment of the invention. The cover means 2 is in one piece, and does not contain a viewing window. The cover means 2 in general, may be made of a clear or colored thermoplastic material such as polypropylene, but any other thermoplastic would work, i.e. ABS, styrene acrylonitrile, styrene, would be suitable. The cover means 2 has a threaded engaging means 12 on the inner surface thereof. In the case where the cover means 2 comprises a base piece 5 and a jacket 6, as illustrated in FIGS. 6 and 7, the threaded engaging means 12 is found on the inner surface 13 of the base piece 5. The threaded engaging means 12 enables the cover means 2 to be secured to the base means 3. Preferably the threaded engaging means are screw threads which mate with those of the base means. In the case where the cover means 2 comprises a single piece, as illustrated in FIG. 8, the threaded engaging means 12 is found on the inner surface of the cover means 2. In addition, the cover means 2 contains a sealing means 14 which is generally a gasket which, when the cover means 2 is secured to the base means 3, is capable of providing substantially air tight conditions. Preferably the sealing means 14 in accordance with the preferred embodiment of the invention is a polyethylene gasket comprised of 50–99% of low density polyethylene (LDPE), preferably about 75–99% LDPE, more preferably about 98% LDPE. Other thermoplastic materials may be used for the gasket, but generally the LDPE mentioned herein is slightly more rigid, and provides a better air tight seal.

Figure 2:
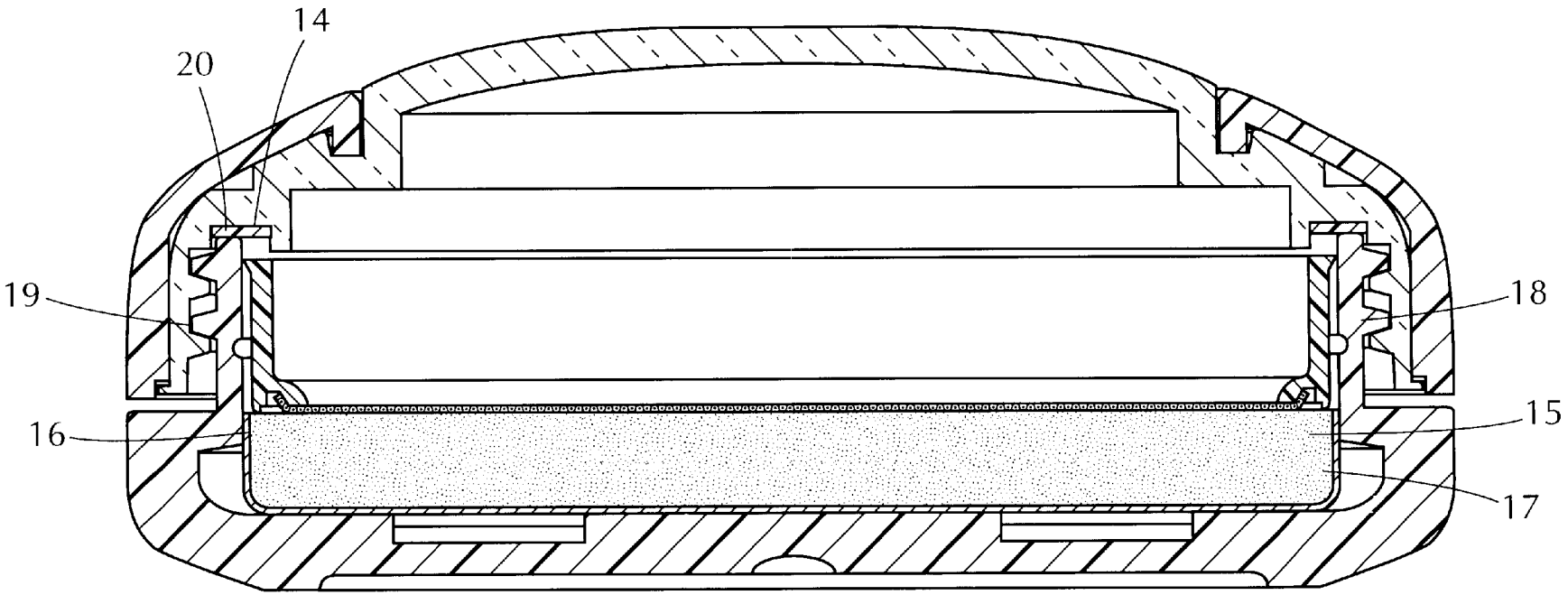
FIG. 2: is a cross-sectional view of the compact of FIG. 1 taken across lines 2—2.
Figure 3:
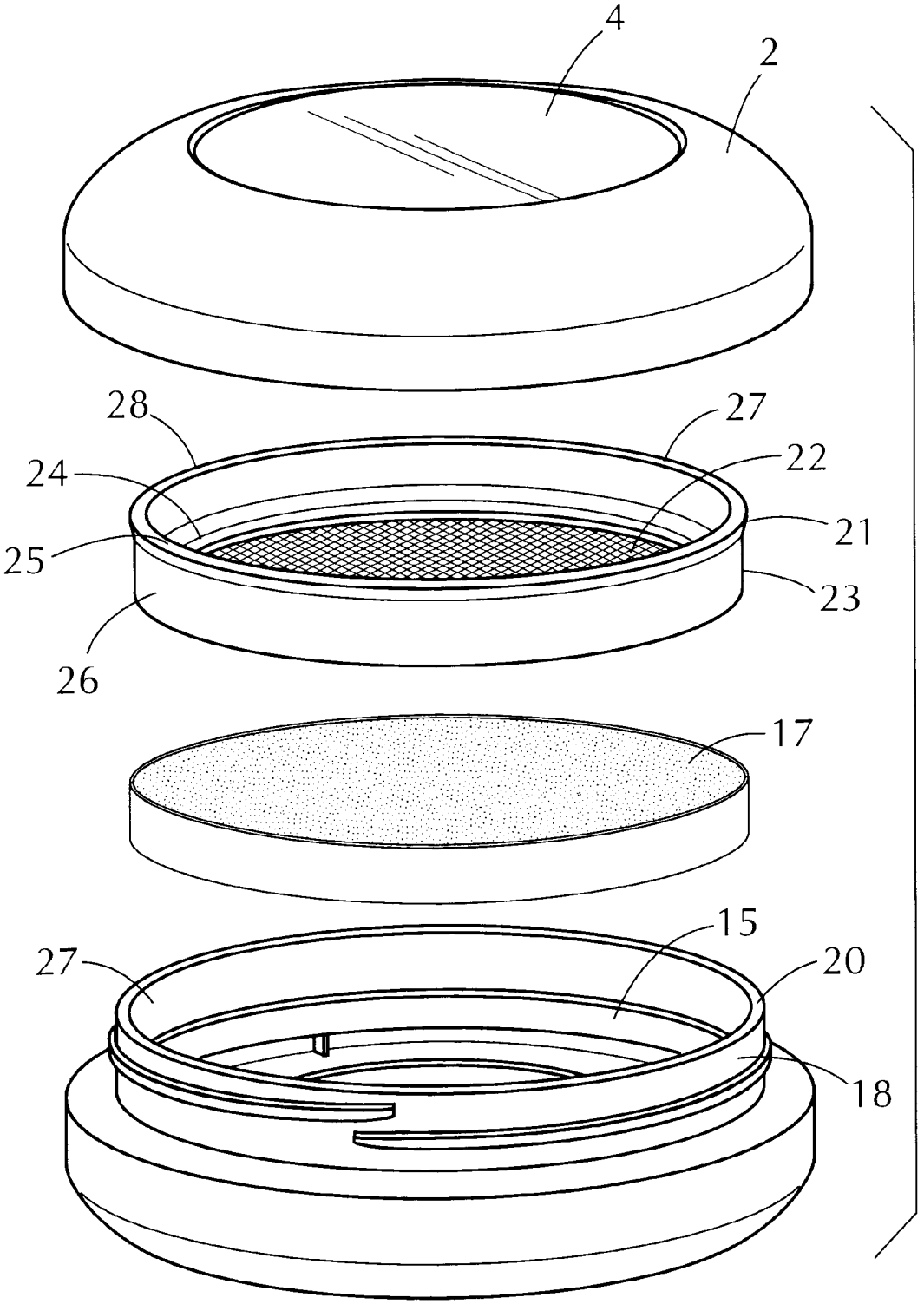
FIG. 3: is an exploded view of the compact of FIGS. 1 and 2, showing one type of product dispensing means.
Figure 9:
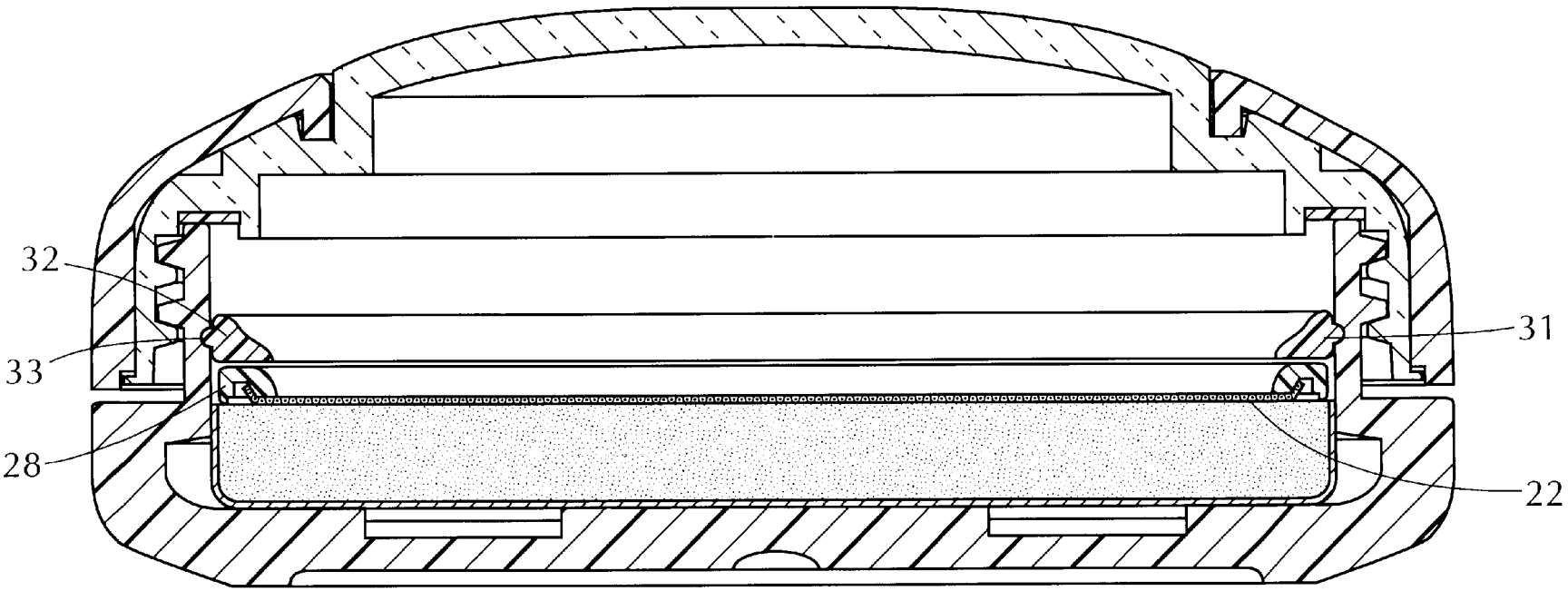
FIG. 9: shows a cross sectional view taken across line 2—2 of FIG. 1, of a compact in accordance with another preferred embodiment of the invention showing a second type of product dispensing means which is in two pieces.
Figure 10:
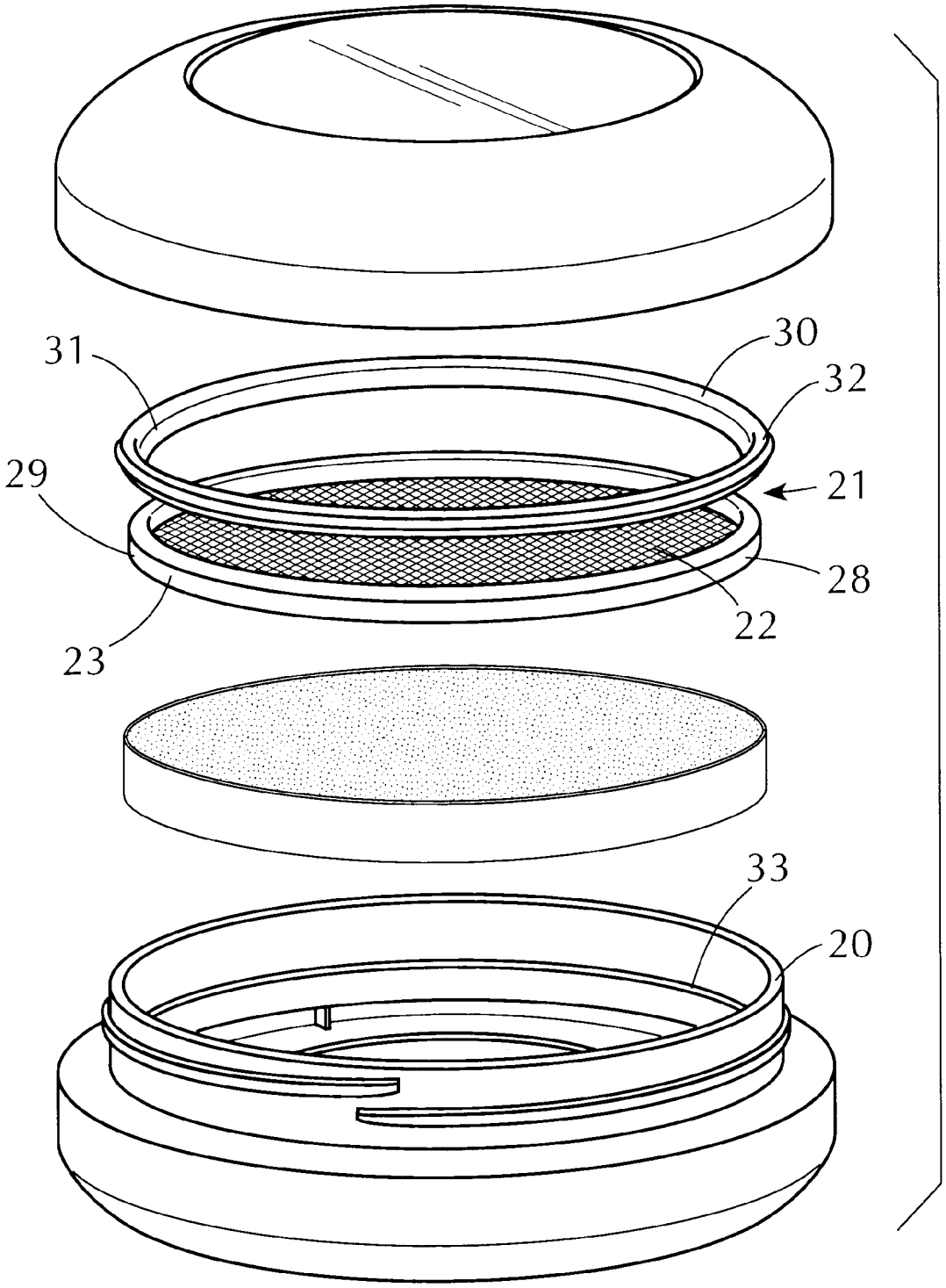
FIG. 10: is an exploded view of the compact of FIG. 9.

The compact also contains a cosmetic dispensing means 21 which comprises a screen 22 made of nylon mesh or another similar thermoplastic mesh material which may be in the woven or non-woven form. Woven mesh has a warp and weft configuration, while non-woven mesh is obtained by puncturing a sheet-like material with holes of a desired size and configuration, for example. Preferably the screen 22 is nylon 6-6 mesh having about 10–100, preferably 15–80, more preferably 20–40 threads per inch. A preferred mesh is sold by Tetko under the tradenames Nitex or Medifab, and in particular is Tetko Nitex 3-475/49 which is a nylon 6-6 mesh having about 38 threads per square inch. The mesh structure enables the cosmetic 17 to be dispensed through the pores of the mesh when the mesh is depressed with a cosmetic sponge, for example (not shown). Preferably the dispensing means 21 is a screen 22 contained in a frame 23 as illustrated in FIGS. 3 and 10. One embodiment of the screen 22 contained in a frame 23 is illustrated in FIG. 3. In this embodiment, the screen 22 which is nylon mesh is contained in a frame 23 which is in a single piece. This frame 23 contains base 24 and sidewalls 25. The frame 23 containing the screen 22 depicted in FIG. 3 is known as a "floating screen" because it fits into the compartment 15 of the base means 3, right on top of the cosmetic 17, which in FIG. 3 has been previously poured into a pan 21A. The sidewalls 25 of the frame 23 have a circumference 26 which is slightly smaller than the circumference 27 of the sidewalls 16 of the base means 3, which enables the dispensing means 21 to sit directly on top of the cosmetic 17 and move up and down, if desired. Such a floating screen is very useful in the case where the cosmetic 17 is purchased in a pan 21A as a refill unit, in the case where the compact 1 is maintained by the user and the cosmetic 17 in the pan 21A is replaced when it has been used up. Preferably the sidewalls 25 of the frame 23 have at the top peripheral surface 27 a slight ridge 28 which is easily gripped with the fingers so that the entire dispensing means 21 can be removed from the compartment 15 of the base means 3 if desired. Another type of dispensing means 21 which may be used in another embodiment of the invention is illustrated in FIG. 10. In this case, the dispensing means 21 is stationary, and is placed over the cosmetic 17. The dispensing means 21 contains a frame 28 for holding the screen 22. The frame 28 has a circumference 29 which is slightly smaller in diameter than the circumference 27 of sidewalls 16 of the base means 3. The dispensing means 21 is secured in the base means by a securing means 30, which is a bezel 31 which fits on top of the dispensing means and secures it into the compartment 15 of the base means 3 directly on top of the cosmetic 17. The bezel 31 has projections 32 which are designed to mate with similarly shaped depressions 33 in the sidewall 16 of the compartment 15 of the base means. The type of dispensing means 21 as depicted in FIG. 10 is stationary. FIG. 2 shows a cross-sectional view of a compact where the dispensing means is as set forth in FIG. 3. FIG. 9 is a cross-sectional view of the compact having the dispensing means as set forth in FIG. 10.

As mentioned previously, when the compact 1 is in the closed position, a substantially air tight seal is obtained when the peripheral side walls 20 of the base means 3 form a substantially air tight fit with the sealing means 14 found in the cover means 2. The substantially air tight seal is obtained when the threaded engaging means 19 of the base means 3 are mated with the threaded engaging means 12 of the cover means 2 and the two pieces secured by screwing together until tightly closed.

While the invention has been described in connection with the preferred embodiment, it is not intended to limit the scope of the invention to the particular form set forth but, on the contrary, it is intended to cover such alternatives, modifications, and equivalents as may be included within the spirit and scope of the invention as defined by the appended claims.

We claim:

1. A compact for holding a cosmetic composition under substantially air tight conditions when in the closed position, comprising:

(a) a base having a compartment with side walls for storing the cosmetic composition, and threaded engaging means on the outer peripheral surface of the side walls, (b) a cover means having threaded engaging means on the inner surface thereof, capable of mating with the threaded engaging means on the outer peripheral surface of the compartment side walls to close the compact, (c) a sealing means between the inner surface of the cover means and the top peripheral surface of the compartment side walls which provides substantially air-tight conditions when the compact is in the closed position, (d) a cosmetic product dispensing means fitted on top of the cosmetic composition stored in the compartment of the base means, having a plurality of apertures which permit the cosmetic composition to be released through the apertures upon application of pressure to the dispensing means.

2. The compact of claim 1 wherein the compartment of the base contains a tray for containing the cosmetic composition.

3. The compact of claim 1 wherein the sidewalls of the base have a top peripheral surface which is flat.

4. The compact of claim 1 wherein the threaded engaging means of the base are screw threads.

5. The compact of claim 1 wherein the threaded engaging means of the cover means are screw threads.

6. The compact of claim 1 wherein the cover means comprises a base piece and a jacket.

7. The compact of claim 6 wherein the base piece is made of a clear thermoplastic material.

8. The compact of claim 7 wherein the base piece has a viewing window having sidewalls.

9. The compact of claim 7 wherein the base piece has two depressions on either side of the sidewalls.

10. The compact of claim 6 wherein the jacket has an opening with sidewalls.

11. The compact of claim 10 wherein the viewing window of the base piece protrudes through the opening of the jacket.

12. The compact of claim 11 wherein the jacket has two protrusions which fit into the two depressions on the base piece.

13. The compact of claim 1 wherein sealing means is a gasket.

14. The compact of claim 13 wherein the gasket is polypropylene.

15. The compact of claim 14 wherein the gasket is low density polypropylene.

16. The compact of claim 1 wherein the dispensing means comprises a screen contained in a frame.

17. The compact of claim 16 wherein the frame of the dispensing means comprises a base and sidewalls.

18. The compact of claim 17 wherein the sidewalls of the frame have a slight ridge at the top peripheral surface.

19. The compact of claim 16 wherein the dispensing means comprises a screen and a frame which are secured into the base by a securing means.

20. The compact of claim 19 where the securing means is a bezel.

21. A compact for holding a cosmetic composition under substantially air tight conditions when in the closed position, comprising:

(a) a base having a compartment with side walls having threaded engaging means on the outer peripheral surface thereof, and a tray secured in said compartment for storing a cosmetic composition, (b) a cover means comprised of a base piece and a jacket, base piece containing a threaded engaging means capable of mating with the threaded engaging means on the outer peripheral surface of the compartment side walls to close the compact, (c) a sealing means between the inner surface of said inner liner of the cover means and the top peripheral surface of the compartment side walls, which provides substantially air-tight conditions when the compact is in the closed position, (d) a dispensing means comprised of a screen and a frame fitted on top of the cosmetic composition stored in the tray, which permits the cosmetic composition to be released through said screen upon application of pressure.

* * * * *